US006155350A

United States Patent [19]

Melenyzer

[11] Patent Number: 6,155,350

[45] Date of Patent: Dec. 5, 2000

[54] BALL SEAT WITH CONTROLLED RELEASING PRESSURE AND METHOD SETTING A DOWNHOLE TOOL BALL SEAT WITH CONTROLLED RELEASING PRESSURE AND METHOD SETTING A DOWNHOLED TOOL

[75] Inventor: George James Melenyzer, Spring, Tex.

[73] Assignee: Baker Hughes Incorporated

[21] Appl. No.: 09/304,325

[22] Filed: May 3, 1999

[51] Int. Cl.[7] ..... F21B 34/10

[52] U.S. Cl. ..... 166/374; 166/317; 166/318

[58] Field of Search ..... 166/318, 317, 166/374

[56] References Cited

U.S. PATENT DOCUMENTS

| | | | |
|---|---|---|---|
| 4,096,913 | 6/1978 | Kenneday et al. | 166/290 |
| 4,099,563 | 7/1978 | Hutchinson et al. | 166/191 |
| 4,427,070 | 1/1984 | O'Brien | 166/317 |
| 4,674,569 | 6/1987 | Revils et al. | 166/154 |
| 4,693,314 | 9/1987 | Wesson et al. | 166/317 |
| 5,318,118 | 6/1994 | Duell | 166/202 |
| 5,392,862 | 2/1995 | Swearingen | 166/386 |
| 5,411,095 | 5/1995 | Ehlinger et al. | 166/317 |
| 5,499,687 | 3/1996 | Lee | 175/317 |
| 5,782,304 | 7/1998 | Garcia-Soule et al. | 166/356 |
| 5,819,853 | 10/1998 | Patal | 166/373 |

*Primary Examiner*—David Bagnell
*Assistant Examiner*—Jennifer M. Hawkins
*Attorney, Agent, or Firm*—Duane, Morris & Heckscher LLP

[57] ABSTRACT

An improved ball seat is described for downhole use. The ball seat can be held in place by one or more shear pins or other fixation devices or by the nature of assembly. A breakable device, such as a rupture disc, is in communication above the ball and with an enlarged piston area below. When the breakable member or rupture disc breaks, the applied pressure is translated to a far larger piston area, and the shear rating of the shear pin or pins is almost instantaneously overcome. Thus, the pressure at which the ball seat releases is determined by the design and rating of the breakable member or rupture disc. The cavity behind the breakable member is preferably grease-filled with a small weep hole to avoid trapping pressure during assembly.

20 Claims, 1 Drawing Sheet

BALL SEAT WITH CONTROLLED RELEASING PRESSURE AND METHOD SETTING A DOWNHOLE TOOL BALL SEAT WITH CONTROLLED RELEASING PRESSURE AND METHOD SETTING A DOWNHOLED TOOL

FIELD OF THE INVENTION

The field of this invention relates to devices for ensuring release of ball seats at predetermined pressures.

BACKGROUND OF THE INVENTION

Many downhole tools require a pressure buildup in order to be actuated. Some examples of this are liner hangers and various downhole packers. One technique for actuating such downhole tools is to provide a ball seat which captures a ball dropped or pumped from the surface. When the ball lands on the seat, a flowpath is obstructed, thus allowing the surface equipment to build up pressure until a predetermined level is reached. When that level is reached, the downhole tool is actuated. A further pressure buildup in designs previously used would result in breakage of a shear pin or pins. When this occurred, the entire ball seat would be blown out with the ball in place, thus reestablishing a passage in the downhole tubulars. One of the problems with shear pin designs is the inherent lack of accuracy involved in using shear pins. First, inaccuracies in release pressures are inherent to the manufacturing process for the shear pin or pins themselves. Secondly, the manner in which the shear pins are installed, and the materials into which they are installed, sometimes affects the pressure at which these pins will fail in shear. The combination of the variability in their release force required to shear the pins and overcome O-ring friction can be as high as ±15% or more in some cases. If the shear pins, for example, are not correctly installed, they do not break cleanly but they tend to extrude, thus affecting the release force required to move the entire ball seat after the downhole tool has set.

Sometimes the shear pins fail prematurely prior to enough pressure having been developed above the ball on the seat to allow the downhole tool to actuate.

It is thus an objective of the present invention to provide a mechanism where the release force required to break loose the ball seat is predictable with more accuracy than has been previously possible to achieve with shear pins alone. Currently, one of the objects of the present invention is to provide an alternative mechanism that can work as the main release threshold level determinant with the possibility of using the device in conjunction with shear pins. Another object is to use the shear pins as temporary fixation devices for the ball seat while using the mechanism of the present invention for accurate and predictable pressure buildup so as to ensure the proper functioning of downhole tools.

SUMMARY OF THE INVENTION

An improved ball seat is described for downhole use. The ball seat can be held in place by one or more shear pins or other fixation devices or by the nature of assembly. A breakable device, such as a rupture disc, is in communication above the ball and with an enlarged piston area below. When the breakable member or rupture disc breaks, the applied pressure is translated to a far larger piston area, and the shear rating of the shear pin or pins is almost instantaneously overcome. Thus, the pressure at which the ball seat releases is determined by the design and rating of the breakable member or rupture disc. The cavity behind the breakable member is preferably grease-filled with a small weep hole to avoid trapping pressure during assembly.

DETAILED DESCRIPTION OF THE PREFERRED EMBODIMENT

Figure 1:
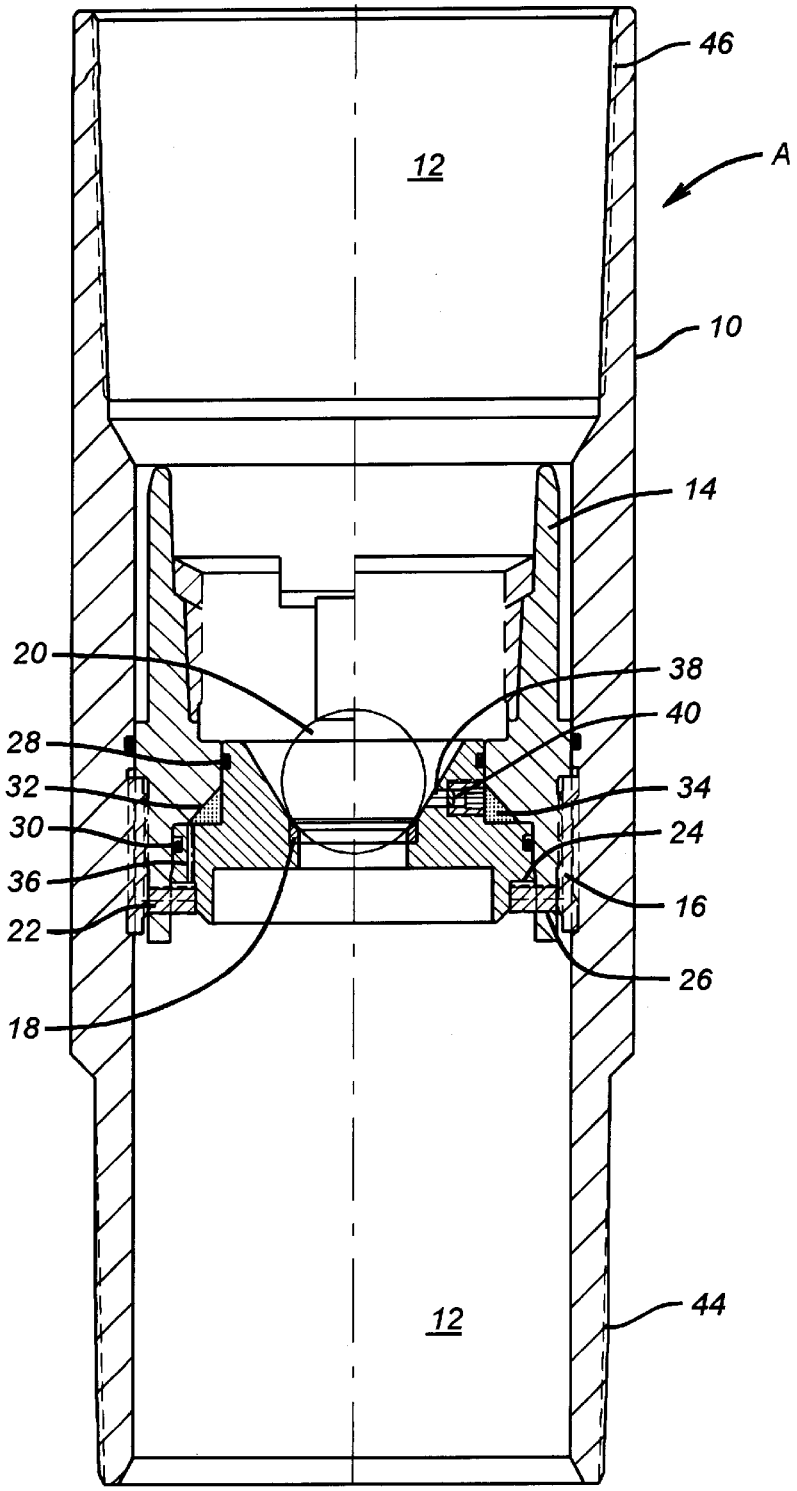
FIG. 1 is a sectional elevational view showing all the components of the ball seat of the present invention prior to release, with the rupture disc on the seat.

Referring to FIG. 1, a body 10 is part of a tubular string (not shown) with which the downhole tool (not shown) is in fluid communication. The body 10 has a central passageway 12 and a ball seat 18. An insert 14 is attached to the body 10 by virtue of a threaded split ring 16, which connects the threads on insert 14 to the threads in the body 10.

The insert 14 has a ball seat 18 which accepts a ball 20, which is selectively dropped or pumped from the surface above to obstruct ball seat 18 for pressure buildup above ball 20 to set the downhole tool (not shown). A series a shear pins 22 secure insert 14 to seat 18. The seat 18 is an assembly which has a proper receptacle 24 to accept shear pin 22. At the same time, insert 14 has a bore 26 through which shear pin 22 is also inserted. One or more shear pins 22 can be used without departing from the spirit of the invention. Other techniques can be used without departing from the spirit of the invention for securing these two parts together, such as shear pins, or even a press fit.

Seals 28 and 30 seal between ball seat 18 and insert 14, defining an annular chamber 32 which is filled with an essentially incompressible lubricious material, such as grease 34. A passage 36 is in fluid communication with chamber 32 so that wellbore pressures in passageway 12, prior to dropping of ball 20, are acting on chamber 32 and the grease 34 therein. The purpose of the passage 36 is to avoid trapping atmospheric pressure in the chamber 32 when the components illustrated in FIG. 1 are assembled at the surface. The operation of the apparatus A would become difficult if chamber 32 was a sealed chamber between seals 28 and 30 with trapped atmospheric pressure in chamber 32. On the other hand, it is undesirable to get the grit and impurities in the drilling fluids into chamber 32 and, thus, it is essentially filled with grease 34 on assembly to prevent migration of wellbore fluids into that space.

Figure 2:
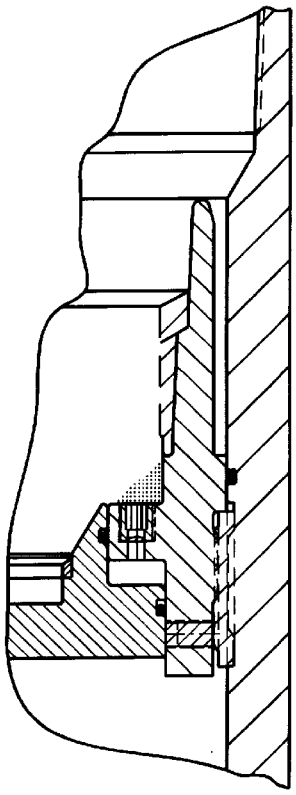
FIG. 2 is an alternative embodiment showing the rupture disc located on the insert instead of the seat.

A passage 38 is connected to a breakable member, such as a rupture disc 40. Passage 38 can be in ball seat 18, as shown in FIG. 1, or in insert 14, as shown in FIG. 2.

The body 10 has an upper thread 42 and a lower thread 44 to connect the body 10 in a tubing string downhole.

The essential components of the invention now having been described, its operation will be reviewed in greater detail. In order to set a downhole tool (not shown), passageway 12 needs to be obstructed at ball seat 18. This is accomplished by dropping or pumping down a ball or other object 20 which lands on ball seat 18 and obstructs passage 12. At that time, pressure is built up sufficiently to set the downhole tool. This pressure will be less than that required to release ball seat 18 from insert 14. The breakable member 40, which in the preferred embodiment is a rupture disc, is set to break at a pressure noticeably higher than the pressure that is required to set the down-hole tool. Once the pressure required to set the downhole tool has been achieved, it is raised by operation of surface equipment until the break or rupture pressure of rupture disc 40 is achieved. Upon the breakage of rupture disc 40, the built up pressure, which has been acting on the ball seat on an area given by the size of seal 28, now acts on a larger area defined by seal 30 as the built up pressure communicates through passage 38 into chamber 32. The result is that a predetermined pressure, known with greater accuracy than simply using shear pins, will break rupture disc 40. Almost instantaneously thereafter, the applied pressure against all the shear pins 22 is of such magnitude due to the increase in applicable area as between the areas of seals 28 and 30 so that the shear failure force of shear pins 22 is readily achieved. As soon as all the shear pins fail, ball seat 18 is driven from insert 14 along with ball 20. Passage 12 is now reopened.

Thus, the principal mechanism for releasing ball seat 18 is the breakable member or rupture disc 40. Those skilled in the art will appreciate that different mechanisms can be used to set the trigger pressure for the release of ball seat 18 from insert 14. Thus, a dissolving member can create a selective barrier similar to a rupture disc and can be removed with the addition of a chemical. Such barriers can also be eliminated either by being dissolved or by chemical attack.

It should be noted that, as the apparatus A is being lowered into the wellbore, the chamber 32 sees the hydrostatic pressure in the wellbore which acts on chamber 32 through passage 36. Since the grease 34 is essentially incompressible, the drilling fluids are kept out of chamber 32 during run-in. This is because the grease 34 stays in chamber 32 during run-in. The momentary pressure build up in chamber 32, as rupture disc 40 breaks, is almost as quickly dissipated as ball seat 18 is displaced out of insert 14.

The foregoing disclosure and description of the invention are illustrative and explanatory thereof, and various changes in the size, shape and materials, as well as in the details of the illustrated construction, may be made without departing from the spirit of the invention.

What is claimed:

1. A seat release apparatus for downhole tubular use, comprising:

a seat for receipt of an object to obstruct a flowpath in a tubular;

an insert mountable to the tubular to support the seat, said insert having a top;

said seat is selectively secured to said insert; and a removable member mounted in a passage exposed to applied pressure at said top of said insert which, when said removable member is removed at a predetermined pressure, causes said seat to release from said insert.

2. The seat release apparatus of claim 1, wherein:

said seat retained to said insert by at least one retainer; and said seat is formed having a smaller cross sectional area near said top of said insert than adjacent said retainer.

3. The seat release apparatus of claim 2, wherein:

said insert and seat form a chamber therebetween which is in fluid communication with said passage when said removable member is removed.

4. The seat release apparatus of claim 3, wherein:

said chamber is isolated from said retainer by at least one first seal.

5. The seat release apparatus of claim 4, wherein:

said chamber is isolated from said top of said insert by at least one second seal.

6. The seat release apparatus of claim 5, wherein:

said second seal has a diameter smaller than said first seal.

7. The seat release apparatus of claim 6, wherein:

said chamber has pressure equalization passage to avoid trapping pressure between said seals.

8. The seat release apparatus of claim 7, wherein:

said chamber is substantially filled with an incompressible material which substantially remains in said chamber as the apparatus is placed downhole.

9. The seat release apparatus of claim 8, wherein:

said removable member comprises a rupture disc; and said retainer comprises at least one shear pin.

10. The seat release apparatus of claim 2, wherein:

said removable member comprises a rupture disc; and said retainer comprises at least one shear pin.

11. A method of setting a downhole tool, comprising:

placing an object onto a seat supported in a tubular;

setting the downhole tool with pressure in said tubular;

raising the pressure further in said tubular;

exposing a passage in said tubular to a chamber due to said raising the pressure further; and using the pressure now in said chamber to release retention of said seat to said tubular.

12. The method of claim 11, further comprising:

exposing said passage by removing a barrier therein.

13. The method of claim 12, further comprising:

providing a rupture disc as said barrier.

14. The method of claim 12, further comprising:

providing an insert in the tubular;

supporting said seat on said insert;

locating said chamber between said seat and said insert; and locating said barrier on said seat or said insert.

15. The method of claim 11, further comprising:

retaining said seat with at least one breakable member.

16. The method of claim 15, further comprising:

using said chamber to increase the area on said seat exposed to said further raised pressure; and breaking said breakable member with an increased force made possible by exposure of pressure in said chamber to a greater area on said seat.

17. The method of claim 16, further comprising:

providing a pressure equalization passage into said chamber so that said chamber operates at wellbore hydrostatic for a given depth.

18. The method of claim 17, further comprising:

filling said chamber with a substantially incompressible material.

19. The method of claim 18, further comprising:

using grease for said substantially incompressible material.

20. The method of claim 11, further comprising:

using a ball as said object placed on said ball seat.

* * * * *